US005361378A

United States Patent [19]

Traini, Jr.

[11] Patent Number: 5,361,378

[45] Date of Patent: Nov. 1, 1994

[54] CAMCORDER STEREO MIC/PHONES

[76] Inventor: Vespucci B. Traini, Jr., #133 Aluminum City Ter., New Kensington, Pa. 15068

[21] Appl. No.: 661,066

[22] Filed: Feb. 26, 1991

[51] Int. Cl.[5] ..... H04R 5/02

[52] U.S. Cl. ..... 381/25; 381/26; 381/74; 381/77

[58] Field of Search ..... 381/25, 26, 74, 77, 381/183, 187

[56] References Cited

U.S. PATENT DOCUMENTS

| | | | |
|---|---|---|---|
| 1,568,721 | 1/1926 | Butcher et al. | 381/183 |
| 4,550,343 | 10/1985 | Nakatani | 381/26 |
| 4,862,278 | 8/1989 | Dann et al. | 358/225 |
| 5,007,091 | 4/1991 | Alasaarela et al. | 381/26 |
| 5,134,660 | 7/1992 | Larose | 381/26 |

*Primary Examiner*—Forester W. Isen
*Attorney, Agent, or Firm*—Nils H. Ljungman & Associates

[57] ABSTRACT

A small AM/FM audio player, operating as a radio, tape, cassette or disc machine can be adjusted to receive music or other audio programs. The received programs can be heard audibly through a stereo Y-adapter set of earphones, and also through a set (pair) of stereo microphones which are clamped by spring loading on to a stereo microphone of a camcorder. The small AM/FM audio player can be programmed to emit any desired program and can be audited by personnel simultaneously with recording the audio program. Thus the picture being shown by the camcorder can be concurrently coordinated with the audio messages inexpensively.

19 Claims, 5 Drawing Sheets

CAMCORDER STEREO MIC/PHONES

BACKGROUND OF THE INVENTION

The invention is classified in Class 338/225,906; 352/27/5.

The invention is related to video recorders equipped with microphones for recording both video images and sound, particularly video camcorders of the type currently sold for home use, having manual or automatic zoom telescopic lens capability. In a U.S. Pat. No. 4,862,278 issued Aug. 29, 1989, Dann and Rapp, a video camera has a zoom lens and a microphone pick-up for recording sound associated with the video images; the acoustic focus of the microphone pick-up is varied between unidirectional and omni-directioned in synchronism with the zoon lens control of the camera.

SUMMARY

A camcorder normally has a unidirectional condenser microphone for simultaneouly sound recording. A stereo set of Y-adapter earphones can be worn by a human programmer concurrently with a second set of earphones emitting the same audio program from an audio player device. The audio program can be operated by the programmer to coordinate with the camcorder picture program. The audio player device can emit a program of music, talking program or other audio programs as desired by the programmer.

The audio player device drives a pair of earphones, the earphone pair are externally clamped by spring bias to the external unidirectional microphone. The player is operated independently by the camcorder operator, as they desire, playing a program as needed.

Included in the objects of this invention are:

To provide an external, manually programmed audio program for a camcorder microphone.

To provide an external music program by an audio player device which can be controlled by a human programmer as an audio input to a camcorder device.

Other objects and advantages of this invention are taught in the following description and claims.

BRIEF DESCRIPTION OF THE DRAWINGS

The description of the invention is to be read in conjunction with the following drawings.

DESCRIPTION OF THE PREFERRED EMBODIMENT OF THE INVENTION

Figure 1:
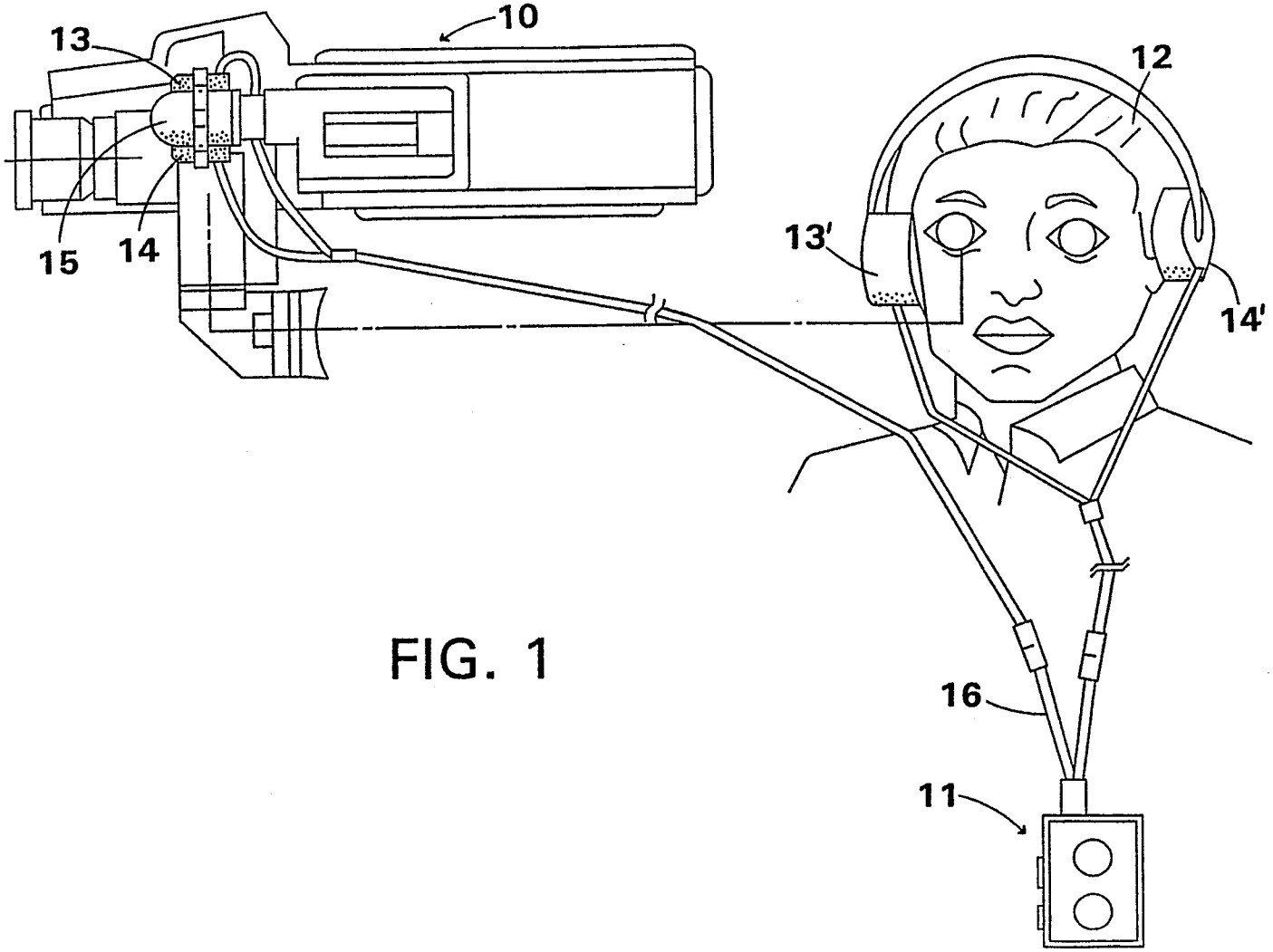
FIG. 1 is a plan view of a camcorder with the combination of the AM/FM audio player in operative position.

Referring to FIG. 1 in detail, there is shown a top plan view of a camcorder 10 in conbination with an AM/FM electronic device 11, which operates as a radio receiver, tape cassette, or disc player, operated by human personnel 12. A pair of earphones 13, 14 are spring biased to be secured as an opposite pair 13, 14 on the exterior of the camcorder condenser microphone 15. The earphones 13, 14 are driven by the electronic mechanism of electronic signal emitter device 11. A Y adapter 16 splits the audio signal for an electronic device 11 into a pair of audio signals, one signal for the earphones 13, 14 and another signal for the earphones 13',14' dispoaed on the head of the personnel 12.

Figure 2A:
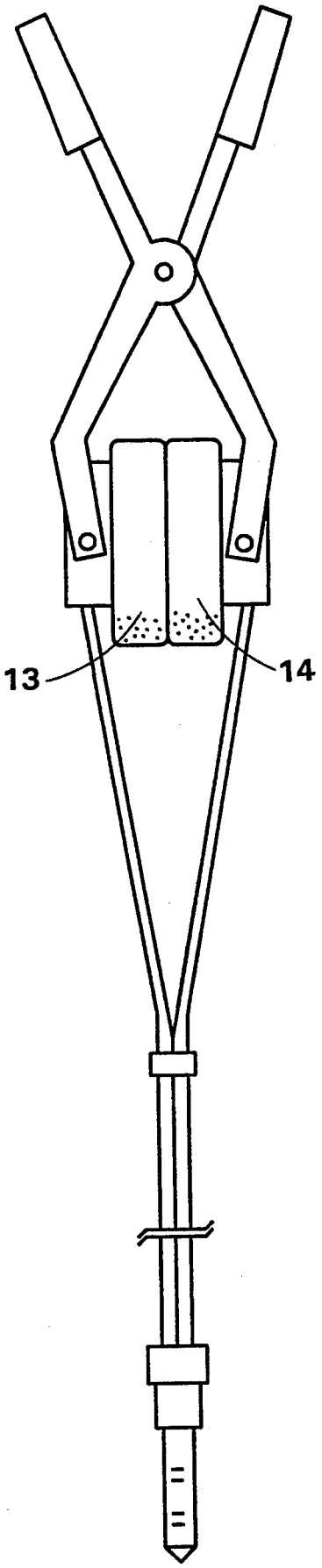
FIGS. 2A, 2B, and 2C is an isometric projective view of the AM/FM audio player prior to its combination with the camcorder.
Figure 2B:
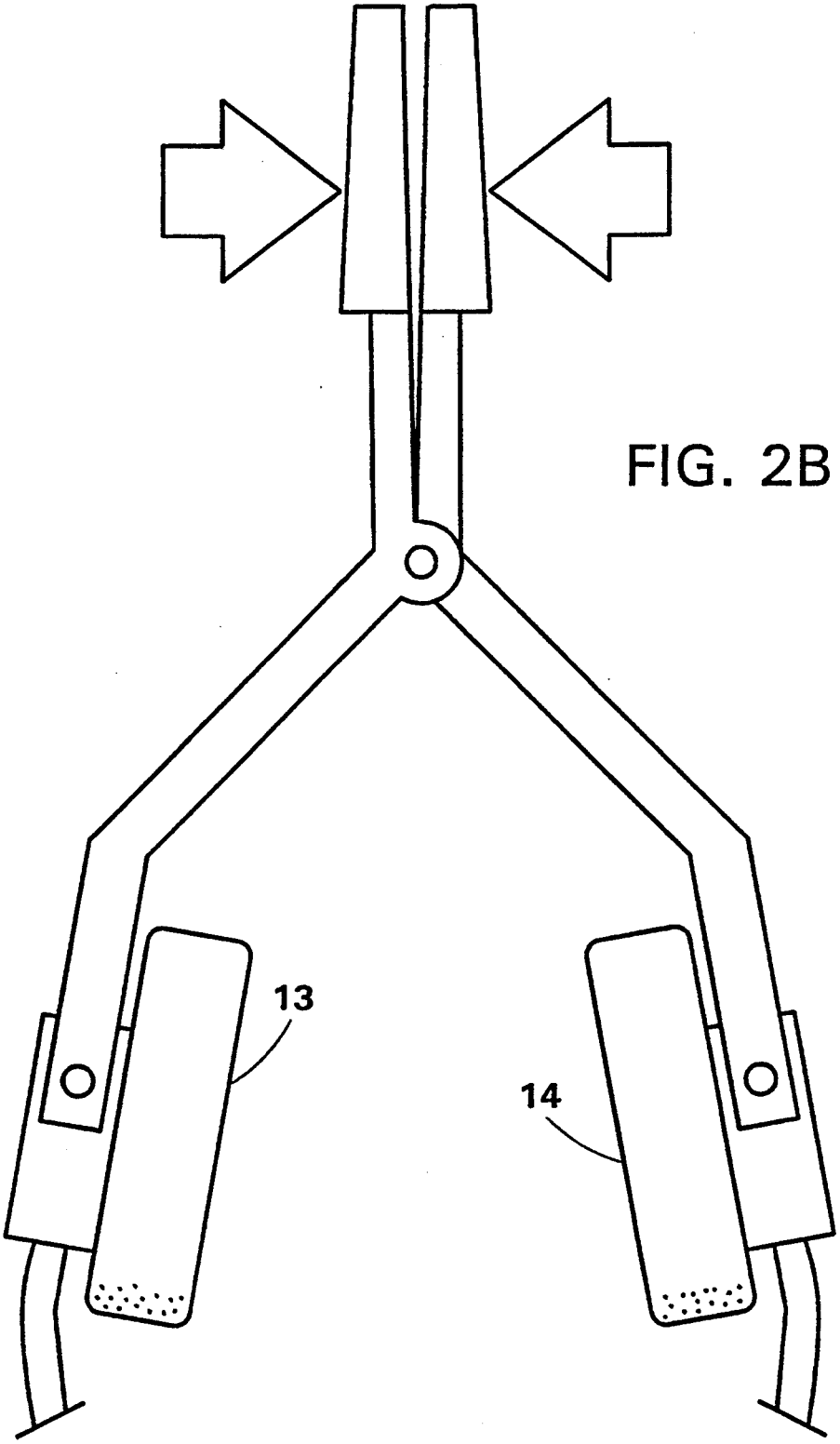
Figure 2C:
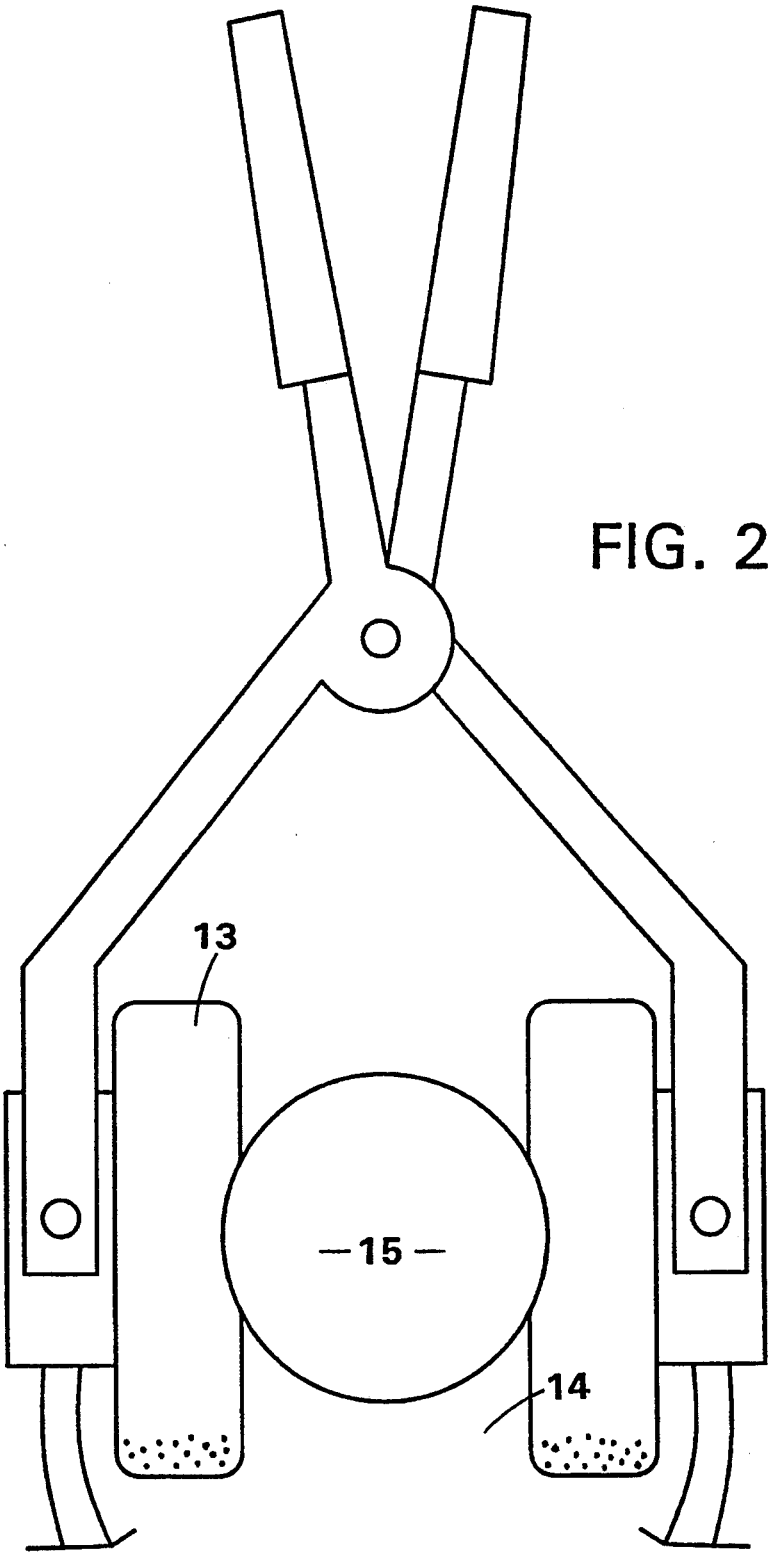

Referring to FIG. 2 in detail, FIG. 2(*a*) illustrates a pair of earphones 13, 14 held together by a spring bias 17,17. The spring bias can be separated as in FIG. 2(*b*), and clamped around the camcorder condenser microphone 15 in earphone opposition 13, 14, as in FIG. 2(*c*). Thus the stereo earphones 13 and 14 can input signals into the condenser microphone 15 of FIG. 2(*c*).

Figure 3:
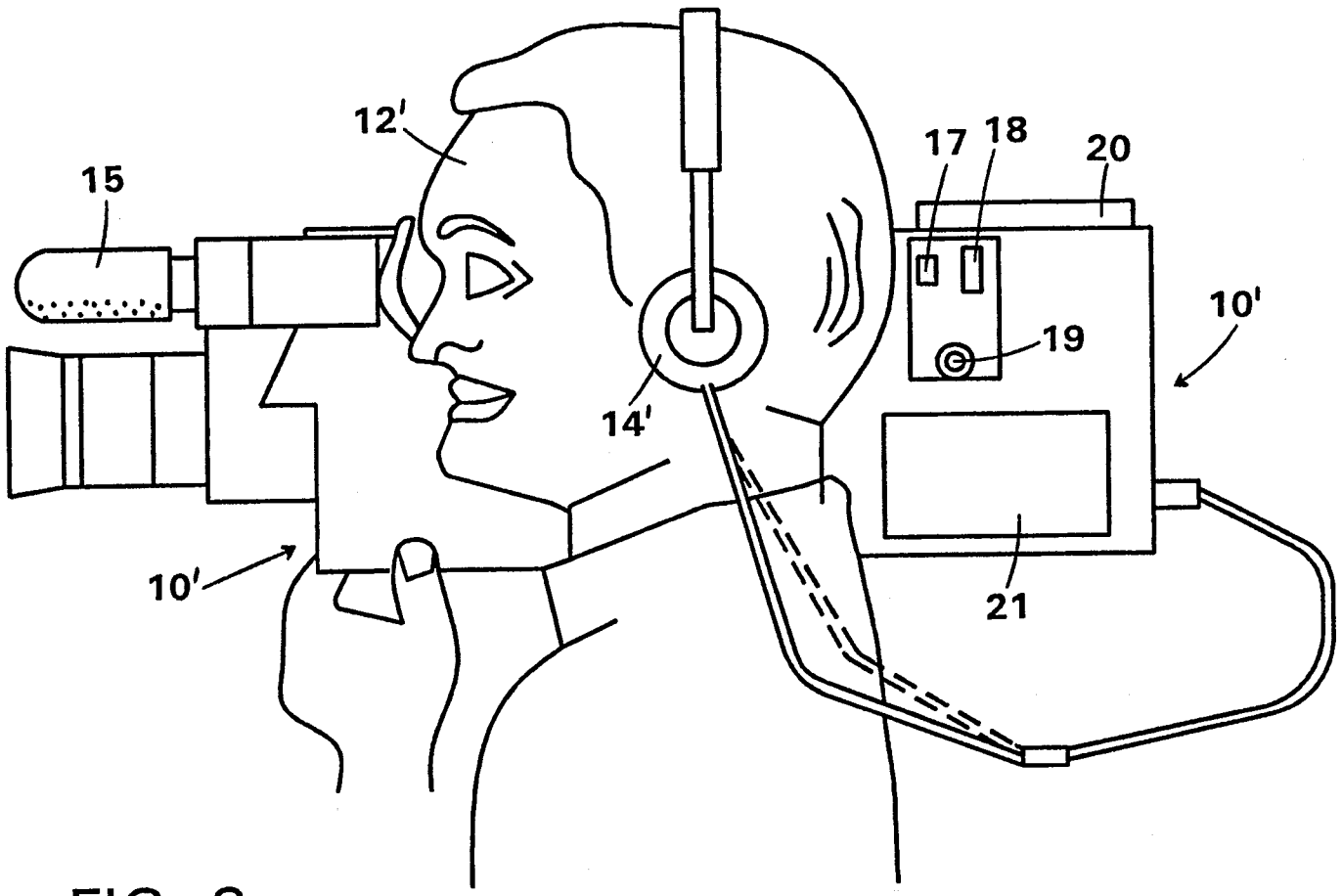
FIG. 3 is a side elevation view of a camcorder operated by personnel.

Referring now to FIG. 3 in detail, there is illustrated a further improvement in camcorder 10', showing alternate audio recording devises, which can be a tape recorder 20 and a disc recorder 21. Each recorder is wired in parallel to the electrical powered camcorder circuit and has separate ON-OFF switches 17 and 18 and a volume control resistor circuit 19. The earphones 13' and 14' (not shown) can be plugged into the camcorder electric circuit in order to monitor the volume of music or audio talk emitted into the camcorder.

Many modifications in the improvements in camcorders can be made in light of my teachings. It is understood that within the scope of the claims, the invention can be practiced otherwise than as described.

I claim:

1. A stereo camcorder background sound apparatus for connecting an audio source to a microphone on a portable camcorder, which microphone has an exposed exterior surface, said apparatus comprising:

first wire means;

said first wire means terminating at a first end to receive an audio-equivalent electrical signal from the audio source;

said first wire means terminating at a second end and a third end in stereo speakers;

said stereo speakers comprising:

a first speaker unit and a second speaker unit;

said microphone on the portable camcorder being very substantially smaller than a width dimension of a human head;

attachment means being configured for attaching said stereo speakers to the exterior surface of the microphone of the portable camcorder so as to direct sound preferentially into the microphone of the portable camcorder;

said attachment means comprising:

means for connecting said first speaker unit of said stereo speakers to said second speaker unit of said stereo speakers;

said means for connecting having a first portion, a second portion and a third portion;

said third portion comprising:

means for permitting pivoting of said first and said second speaker units of said stereo speakers with respect to one another;

said means for permitting pivoting comprising pin means;

said first speaker unit of said stereo speakers being disposed along said first portion;

said second speaker unit of said stereo speakers being disposed along said second portion;

at least a portion of said third portion being disposed between said first portion and said second portion;

biasing means;

said biasing means being configured to act upon said means for connecting to pivot said first and said second speaker units of said stereo speakers towards one another to grasp the microphone of the portable camcorder;

means for receiving force to pivot said first and said second speaker units of said stereo speakers away from one another to create a distance between said stereo speakers and to permit said stereo speakers to grasp the microphone of the portable camcorder;

said means for receiving force being disposed on said first portion and said second portion;

said means for receiving force being disposed adjacent to said third portion;

said means for receiving force comprising:

a first means for receiving force and a second means for receiving force;

said first means for receiving force being disposed at a first end of said first portion;

said second means for receiving force being disposed at a first end of said second portion;

said pin means being disposed between said first and said second means for receiving force;

said first means for receiving force extending away from said third portion;

said second means for receiving force extending away from said third portion;

said apparatus further comprising:

an open position for attaching said apparatus to the microphone of the portable camcorder;

an unopen position;

a height;

a width when said apparatus is in said open position;

a length for being disposed along the longitudinal dimension of the microphone of the portable camcorder;

said width of said apparatus both in said open position and said closed position being very substantially smaller than a width dimension of a human head;

said height of said apparatus being very substantially smaller than a height dimension of a human head.

2. The apparatus according to claim 1 wherein:

said first portion comprises a first distance extending from said first end of said first portion to said pin means;

said first portion comprises a second distance extending from said pin means to said first speaker unit of said stereo speakers;

said second portion comprises a third distance extending from said first end of said second portion to said pin means;

said second portion comprises a fourth distance extending from said pin means to said second speaker unit of said stereo speakers;

said first distance of said first portion and said second distance of said first portion are substantially the same;

said third distance of said second portion and said fourth distance of said second portion are substantially the same;

said first distance and said second distance are substantially the same as to said third distance and said fourth distance.

3. The apparatus according to claim 2 wherein:

said means for receiving force to pivot said first and said second speaker units of said stereo speakers away from one another comprises solely said first means for receiving force and said second means for receiving force.

4. The apparatus according to claim 3 wherein:

said first portion comprises a first substantially straight portion and a second substantially straight portion;

said second portion comprises a third substantially straight portion and a fourth substantially straight portion.

5. The apparatus according to claim 4 wherein:

said first substantially straight portion of said first portion extends from said pin means towards said first end of said first portion;

said third substantially straight portion of said second portion extends from said pin means towards said first end of said second portion.

6. The apparatus according to claim 5 wherein:

said second substantially straight portion of said first portion extends from said pin means towards said first speaker unit of said stereo speakers;

said fourth substantially straight portion of said second portion extends from said pin means towards said second speaker unit of said stereo speakers;

said first substantially straight portion of said first portion and said third substantially straight portion of said second portion are substantially the same as said first distance of said first portion and said third distance of said second portion;

said second substantially straight portion of said first portion and said fourth substantially straight portion of said second portion are substantially the same as to said second distance of said first portion and said fourth distance of said second portion.

7. The apparatus according to claim 6 wherein said apparatus further comprises:

an adjustable volume control between the audio source and said stereo speakers.

8. The apparatus according to claim 7 wherein said apparatus further comprises at least one earphone;

said at least one earphone being provided for use by a human operator of the portable camcorder to monitor the audio-equivalent electrical signal emitted from the audio source.

9. The apparatus according to claim 8 wherein said apparatus further comprises second wire means;

said second wire means terminating at a first end to receive the audio-equivalent electrical signal from the audio source;

said second wire means terminating at a second end and a third end in said at least one earphone.

10. The apparatus according to claim 9 wherein:

said biasing means are configured to act upon said means for connecting to pivot said first and said second speaker units of said stereo speakers toward one another to permit contact between said first and said second speaker units of said stereo speakers when said apparatus is in said unopened position;

said first and second speaker units comprise a length for being disposed along the longitudinal dimension of the microphone of a portable camcorder;

said length of said first and second speaker units is substantially the same as said first, second, third, and fourth distances of said first and second portions.

11. The apparatus according to claim 1 wherein:

said means for receiving force to pivot said first and said second speaker units of said stereo speakers away from one another comprises solely said first means for receiving force and said second means for receiving force.

12. The apparatus according to claim 11 wherein:

said first portion comprises a first distance extending from said first end of said first portion to said pin means;

said first portion comprises a second distance extending from said pin means to said first speaker unit of said stereo speakers;

said second portion comprises a third distance extending from said first end of said second portion to said pin means;

said second portion comprises a fourth distance extending from said pin means to said second speaker unit of said stereo speakers.

13. The apparatus according to claim 12 wherein:

said first portion comprises a first substantially straight portion and a second substantially straight portion;

said second portion comprises a third substantially straight portion and a fourth substantially straight portion.

14. The apparatus according to claim 13 wherein:

said first substantially straight portion of said first portion extends from said pin means towards said first end of said first portion;

said third substantially straight portion of said second portion extends from said pin means towards said first end of said second portion.

15. The apparatus according to claim 14 wherein:

said second substantially straight portion of said first portion extends from said pin means towards said first speaker unit of said stereo speakers;

said fourth substantially straight portion of said second portion extends from said pin means towards said second speaker unit of said stereo speakers;

said first substantially straight portion of said first portion and said third substantially straight portion of said second portion are substantially the same as said first distance of said first portion and said third distance of said second portion;

said second substantially straight portion of said first portion and said fourth substantially straight portion of said second portion are substantially the same as said second distance of said first portion and said fourth distance of said second portion.

16. The apparatus according to claim 15 wherein said apparatus further comprises:

an adjustable volume control between the audio source and said stereo speakers.

17. The apparatus according to claim 16 wherein said apparatus comprises at least one earphone;

said at least one earphone being provided for use by a human operator of the portable camcorder to monitor the audio-equivalent electrical signal emitted from the audio source.

18. The apparatus according to claim 17 wherein said apparatus further comprises a second wire means;

said second wire means terminating at a first end to receive the audio-equivalent electrical signal from the audio source;

said second wire means terminating at a second end and a third end in said at least one earphone.

19. The apparatus according to claim 18 wherein:

said biasing means are configured to act upon said means for connecting to pivot said first and said second speaker units of pg,15 said stereo speakers toward one another to permit contact between said first and said second speaker units of said stereo speakers when said apparatus is in said unopened position;

said first and second speaker units comprise a length for being disposed along the longitudinal dimension of the microphone of the portable camcorder;

said length of said first and second speaker units is substantially the same as said first, second, third, and fourth distances of said first and second portions.

* * * * *

UNITED STATES PATENT AND TRADEMARK OFFICE

CERTIFICATE OF CORRECTION

PATENT NO. : 5,361,378

DATED : November 1, 1994

INVENTOR(S) : Vespucci B. Traini, Jr.

It is certified that error appears in the above-indentified patent and that said Letters Patent is hereby corrected as shown below:

In column 3, line 60, Claim 2, after 'as', delete "to".

In column 4, line 29, Claim 6, after 'as', delete "to".

In column 6, line 28, Claim 19, after 'of', delete "pg. 15".

Signed and Sealed this

Thirtieth Day of May, 1995

Bruce Lehman

*Attest:*

BRUCE LEHMAN

*Attesting Officer*

*Commissioner of Patents and Trademarks*